United States Patent [19]

Glattfelder et al.

[11] Patent Number: 4,481,799

[45] Date of Patent: Nov. 13, 1984

[54] ARRANGEMENT FOR REGULATING A ROLLING MILL FOR METAL ROLLING

[75] Inventors: Adolf Glattfelder, Zürich; Heinz Güttinger, Schaffhausen; Josef Mercx, Baden, all of Switzerland

[73] Assignee: Escher Wyss Aktiengesellschaft, Zürich, Switzerland

[21] Appl. No.: 350,631

[22] Filed: Feb. 22, 1982

[30] Foreign Application Priority Data

Mar. 13, 1981 [DE] Fed. Rep. of Germany ..... 3109536

[51] Int. Cl.[3] ..... B21B 37/12

[52] U.S. Cl. ..... 72/8; 29/113 AD; 29/116 AD; 72/10; 72/19; 72/20; 72/21; 72/241; 72/243; 100/162 B

[58] Field of Search ..... 72/241, 243, 8, 9, 10, 72/19, 20, 21; 29/113 AD, 116 AD; 100/162 B

[56] References Cited

U.S. PATENT DOCUMENTS

| | | | |
|---|---|---|---|
| 3,803,886 | 4/1974 | Sterrett et al. | 72/8 |
| 3,938,360 | 2/1976 | Shida et al. | 72/8 |
| 4,319,522 | 3/1982 | Marchidro et al. | 72/245 X |

*Primary Examiner*—Francis S. Husar
*Assistant Examiner*—Steven B. Katz
*Attorney, Agent, or Firm*—Werner W. Kleeman

[57] ABSTRACT

An arrangement for regulating a rolling mill for metal rolling, the work rolls of which are supported by guided roll shells of a lower controlled deflection roll and an upper controlled deflection roll, the roll shells being supported by means of hydrostatic pressure or support elements upon a related roll support or beam. First regulation circuits are provided for regulating the pressure of the pressure or support elements of the controlled deflection rolls. A second regulation circuit for the position of the roll shells overrides the first regulation circuits, so that adjustment output magnitudes of the second regulation circuit can be impressed as reference or set values or adjustment magnitudes upon the first regulation circuits. There is also provided a third regulation circuit for the rolling force or the roll nip which overrides the second regulation circuit, so that the adjustment output magnitude of the third regulation circuit can be impressed as a reference or set value or adjustment magnitude upon the second regulation circuit.

18 Claims, 7 Drawing Figures

ARRANGEMENT FOR REGULATING A ROLLING MILL FOR METAL ROLLING

BACKGROUND OF THE INVENTION

The present invention relates to a new and improved arrangement for regulating a rolling mill, particularly a so-called four-high rolling mill for the rolling of metal.

Generally speaking, the four-high rolling mill for metal rolling is of the type whose work rolls are supported by the guided, usually cam-guided, roll shells of a lower controlled deflection roll and an upper controlled deflection roll. The roll shells are supported by means of hydrostatic pressure or support elements upon a related roll or support beam.

Such type of rolling mill has been described and illustrated in German Patent Publication No. 2,507,233 and the corresponding U.S. Pat. No. 4,509,976, granted Nov. 29, 1977, without any specific reference being made however to the rolling of metals.

For the rolling of metals this arrangement with two cam-guided, that is to say, so-called "floating" roll shells, in other words roll shells which are not fixed at their ends by bearings in their vertical direction, is preferred because there is thereby realized a large number of degrees of freedom of movement.

What is ultimately strived for during metal rolling is a specific reduction in the thickness of the rolled material or stock. Therefore, it would be obvious to measure the thickness of the rolled material following the roll gap or nip and, as a function of the deviations of the measured actual value from a predetermined reference or set value, to act upon those elements which affect the rolling operation. In the case of a rolling mill of the above-described type it is therefore necessary to act upon the hydrostatic pressure or support elements.

However, such technique is associated with appreciable difficulties. Firstly, it is impossible to avoid that appreciable delays in time are associated with the measurement of the thickness of the rolled material or stock, because the conventional throughflow rate thickness-measuring devices output an irregular pulse train which must be meaned or averaged as a function of time. Additionally, the roll shells are advantageously supported by a multiplicity of independently controllable pressure elements, so that the force exerted by the individual pressure or support elements or pressure elements connected together into groups, upon the related roll shell can be individually adjusted. In such case it would be possible to operatively associate, as taught in German Patent Publication No. 2,555,677 and the corresponding U.S. Pat. No. 4,074,624, granted Feb. 21, 1978, with each such group of pressure or support elements its own thickness measuring device and to construct a correspondingly large number of parallel regulation circuits. Yet, the equipment expenditure with this system design, particularly for metal rolling mills, would be hardly justifiable. Moreover, there would still remain unsolved the problem of controlling the regulation operation as a function of time.

A further aspect during the design of a regulation system for rolling mills of the type here under discussion pertains to the economies of the system. It will be appreciated that the specifications for the rolling operation appreciably differ depending upon the rolled product, for instance there play a role such factors as the nature of the material from which the product to be rolled is formed, such as whether it is formed of steel, aluminium, the hardness of the material, the work speed and so forth. With a direct regulation as above-described it would be necessary to provide for each individual field of use or application a specially constructed or "tailored" regulation arrangement. Obviously, this would entail a correspondingly expensive development and construction work for each individually encountered situation, even if the mechanical components or parts of the system, such as the work rolls and the back-up or support rolls, essentially remain unchanged in their design or construction.

SUMMARY OF THE INVENTION

Therefore, with the foregoing in mind it is a primary object of the present invention to provide a new and improved arrangement for regulating a rolling mill for metal rolling in a manner not afflicted with the aforementioned drawbacks and limitations.

Another and more specific object of the present invention aims at devising a regulation arrangement for a rolling mill of the previously mentioned type, which enables controlling the time problems discussed heretofore and allowing at least for a number of components a standardization, yet the total arrangement can still be accommodated to the individually encountered situation or working operation to be performed at the rolling mill.

Yet a further significant object of the present invention relates to a new and improved arrangement for regulating a rolling mill, particularly a four-high rolling mill, for rolling metals, which enables adaptation of the rolling mill to the particularly processed materials and operating conditions intended to prevail at the rolling mill.

Now in order to implement these, and still further objects of the invention, which will become more readily apparent as the description proceeds the inventive arrangement for regulating a four-high rolling mill for rolling metals, is manifested by the features that there are provided first regulation circuits for the regulation of the pressures of the pressure elements of the controlled deflection rolls. A second regulation circuit serves for regulating the position of the roll shell and overrides the first regulation circuits, so that the adjustment output magnitudes of the second regulation circuit can be impressed upon the first regulation circuits as reference or set value or adjustment magnitudes. Additionally, there is provided a third regulation circuit for regulating the rolling force or the roll nip and such third regulation circuit overrides the second regulation circuit, so that the adjustment output magnitudes of the third regulation circuit can be impressed upon or inputted to the second regulation circuit as the adjustment or set value or adjustment magnitude.

Accordingly, the regulation arrangement of the present development is constructed from at least three mutually hierarchical regulation circuits, wherein the lowest regulation stage in the hierarchy, the pressure regulation of the pressure or support elements, can be standardized, whereas the other stages which are more directly related to the systems operation, the so-called "operating-proximity" stages can be increasingly accommodated to the individual situation which is encountered. For the standard operation the regulation arrangement as described above and constructed according to the invention, has been already found to be satisfactory, so that, if desired, it is possible to dispense with a thickness measurement itself. Generally, such thickness measurement of the rolled material or stock is, however, provided and then can be incorporated as a fourth regulation circuit which overrides the third regulation circuit. This fourth regulation circuit can be provided with a correspondingly long time-constant, since short-term fluctuations are already eliminated by the regulation action of the subordinate regulation circuits.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
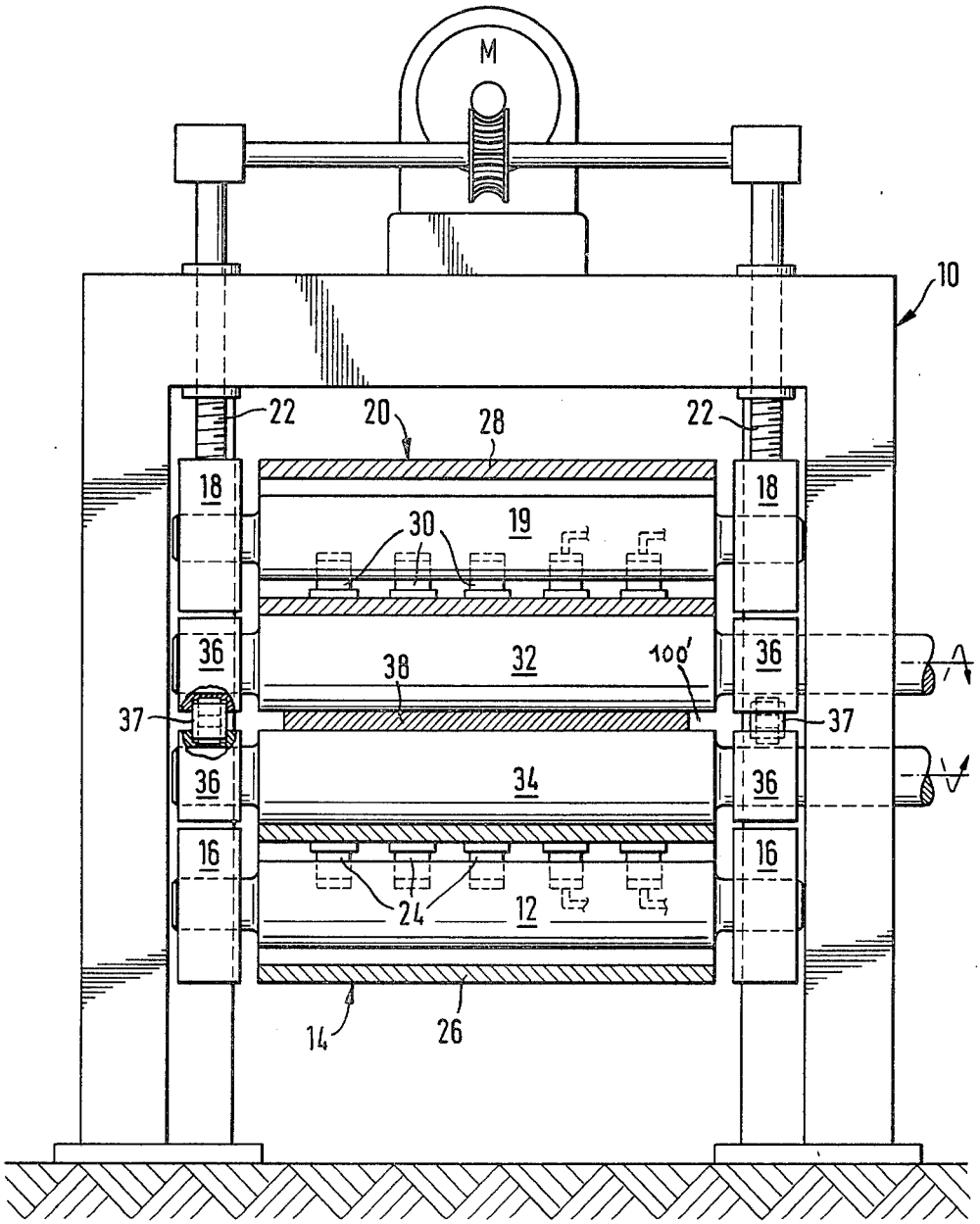
FIG. 1 is an extensively schematic vertical sectional view of a rolling mill, here a four-high rolling mill, with which there can be employed the regulation arrangement of the present development.

Describing now the drawings, it is to be understood that only enough of the construction of the rolling mill has been shown to enable those skilled in the art to readily understand the underlying principles and concepts of the present development, while simplifying the illustration of the drawings. Thus, by turning attention now to FIG. 1 there will be recognized a roll stand 10 at which there is directly attached the roll support or beam 12 of a lower controlled deflection roll 14, by means of any suitable roll support-mounting elements 16. On the other hand, the mounting elements 18 for the roll support or beam 19 of the upper controlled deflection roll 20 are arranged in the roll stand 10 so as to be elevationally adjustable by means of motor-driven spindles 22 or any other equivalent adjustment facility. The lower roll shell 26 of the lower controlled deflection roll 14 bears upon the roll support or beam 12 by means of fluid-operated, here hydrostatic, pressure or support elements 24. At the upper roll support or beam 19 the upper roll shell 28 of the upper controlled deflection roll 20 is supported by means of the hydrostatic pressure or support elements 30. It is here to be remarked that in the schematic illustration of the rolling mill shown in FIG. 1, there have only been conveniently shown for each of the controlled deflection rolls 14 and 20 five respective upper pressure or support elements 24 and lower pressure or support elements 30. In reality, however, the number of such pressure or support elements 24 and 30 is much greater and, for instance, can amount to twenty-four such pressure of support elements for each roll shell. As to the work pressure, in each instance however a predetermined number of pressure elements arranged adjacent one another are connected in parallel, so that—with the illustrated exemplary embodiment—there would result five "zones" extending lengthwise of the width of the roll nip or gap, generally indicated by reference character 100', each of such five zones having inputted thereto its own adjustment signal.

As is conventional practice when working with four-high rolling mills, there are interposed between the upper controlled deflection roll 20 and the lower controlled deflection roll 14 both of the driven work rolls 32 and 34 by means of their mounting elements or mounting means 36. At both sides of the work rolls 32 and 34 there are provided so-called balancing cylinder units 37, in other words, hydraulic cylinder units which when pressurized press both of the work rolls 32 and 34 away from one another, and thus, open the roll nip 100'. In FIG. 1 the rolled material or stock 38 has been shown located within the roll nip 100'. It is here to be remarked that the balancing cylinders 37, during operation of the rolling mill, are pressurized, and thus, oppose the action of the pressure or support elements 24 and 30, whereby such can exert bending moments because of their engagement at the ends of the work rolls 32 and 34. Such is to be taken into account during the design of the regulation characteristic for the pressure elements or the zonewise groups of pressure or support elements, as the case may be.

Figure 2:
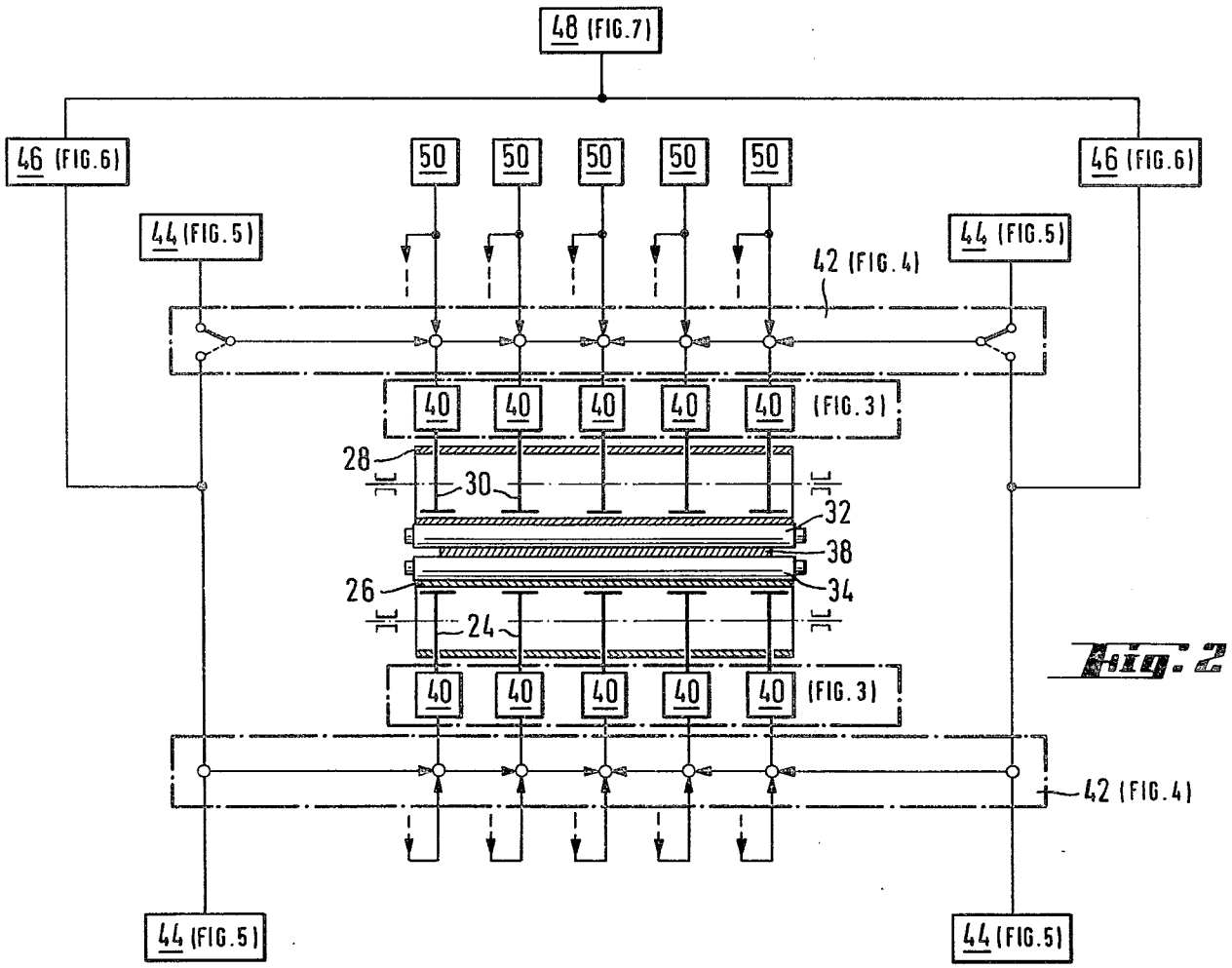
FIG. 2 is a block circuit diagram of a regulation arrangement according to the invention.

With reference now to FIG. 2 there will be explained the regulation concept which constitutes the subject matter of the invention. The roll stand 10 has here only been symbolized by the work rolls 32 and 34, the roll shells 26 and 28 and the related pressure or support elements 24 and 30. Each of the five groups of pressure or support elements 24 and 30, respectively, briefly referred to as "zones", has operatively associated therewith a respective pressure regulator 40. Each such pressure regulator 40 delivers in the form of its output adjustment signal the pressure with which there should be controlled the pressure or support elements of the related zone. The construction of the pressure regulator 40 will be explained more fully hereinafter in conjunction with FIG. 3. In the exemplary embodiment under discussion there are provided a total of ten pressure regulators 40, to which there are inputted the reference or set value by the related reference or set value distributors 42.

During the forming of the reference or set value there are utilized the adjustment signals of position regulators 44 which, in turn, employ the adjustment signals for the formation of their reference or set value, these adjustment signals being supplied by means of the roll nip or roll force regulators 46. With this system design the machine operator can select whether the roll nip or the roll pressure is to be regulated. Finally, in FIG. 2 there has also been indicated the rolled material thickness-correction device 48.

During the set or reference value formation there is provided the possibility of incorporating at the pressure regulators 40 correction signals which either can be formed manually by the machine operator or based upon output signals of individual measuring elements arranged after the roll nip 100'. It is to be observed that such correction signals act upon the upper support elements 30 and the lower support elements 24 of each zone in the same sense, i.e. raise or lower the pressure at the top and bottom of the arrangement, as the case may be, in order to avoid the formation of impermissible distortions or overloading of the roll shells 28 and 26. Accordingly, there have here only been indicated in FIG. 2 the correction reference value or set value transmitters 50.

Figure 3:
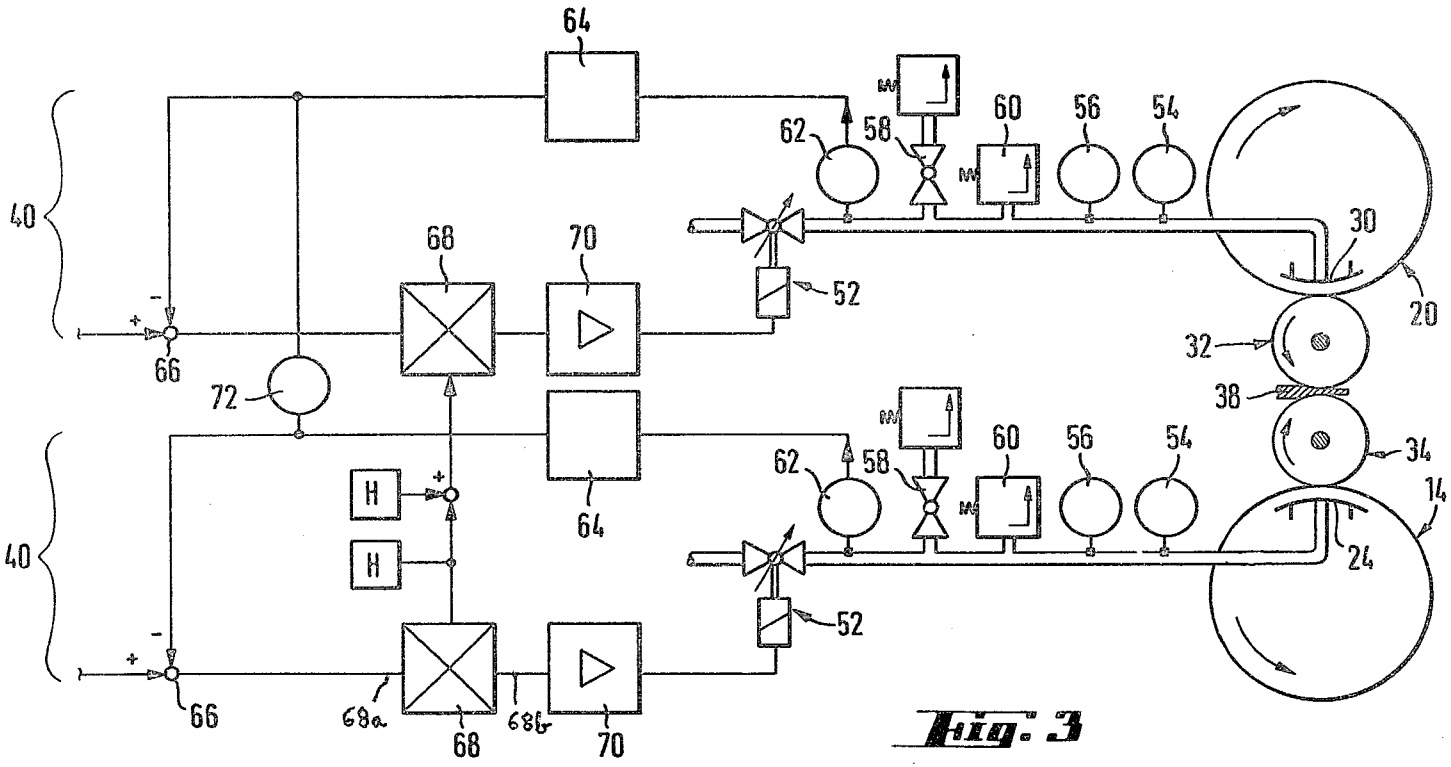
FIG. 3 likewise depicts in block circuit diagram details of the subordinated pressure regulation circuit of the arrangement of FIG. 2.

In FIG. 3 there have been shown the pressure regulators 40 of two oppositely situated zones of the roll nip 100'. In principle, both of these pressure regulators 40 are similarly constructed and operate independently of one another. Therefore, it should suffice to describe only one of the pressure regulators 40.

The operating pressure is infed by an adjustment element 52 to the pressure or support elements 24 and 30, as the case may be. As to the adjustment element 52 such may be constituted by a control valve, a controlled pump or other equivalent component. Since the pressure or support elements 24 and 30 have been here constructed as hydrostatic support bearings, it is advantageous to monitor certain magnitudes following the adjustment element 52. It should be understood that upon exceeding certain safety thresholds or boundaries there can be provided an automatic shutdown of the system.

The hydrostatic support bearings or elements require a certain minimum throughflow rate of the hydraulic oil, in order to insure for the lubrication of the related revolving roll shell. Therefore, it would be possible to provide a (expensive) throughflow rate monitor 54, since even in the presence of an adequate high pressure the throughflow rate nonetheless may be too small due to clogging of the line. A pressure monitor 56 protects against mechanical overload in the pressence of too high pressure. A controlled relief valve 58 enables venting the system behind the adjustment element 52. Finally, there is also provided a safety valve 60.

The actual value of the pressure behind the adjustment element 52 is detected by means of the pressure measuring device 62 and the output signal—in the exemplary embodiment a pressure-proportional electrical voltage—is inputted to a signal accommodation converter 64, in order to obtain standardized input magnitudes for the actual regulator. Its output signal is compared in the comparator 66 with the related reference or set value, and any possible difference is inputted to the input side 68*a* of a PID-regulator 68. There can be impressed upon the PID-regulator 68 correction signals from thickness measuring devices and/or correction signals which have been set by the machine operator. The output signal appearing at the output side 68*b* of the PID-regulator 68 is amplified in an amplifier 70 and inputted to the adjustment element 52.

At this point it is remarked that it is completely concievable to only stabilize the one roll shell, for instance the lower roll shell 26, with respect to its position in space, and to allow the pressure regulation to act only upon the pressure or support elements 30 of the other roll shell 28. The pressure regulation of both controlled deflection rolls, however, affords the advantage that the quantity of hydraulic oil needed for a certain adjustment of the bite or nip 100' can be distributed to both mutually opposite situated zones, and therefore, the hydraulic installation or system can be dimensioned correspondingly smaller as concerns its throughflow or throughput rate; since the attainable throughput appreciably affects the behaviour as a function of time of the regulation, there is desired in this regard an improvement. In any event, generally the position of both roll shells 26 and 28 of the controlled deflection rolls 14 and 20, respectively, must be regulated, or at least such possibility must be provided during the basic design of the system.

By reverting to FIG. 3 there will be recognized a pressure differential monitor 72 which has inputted thereto the actual pressures of both regulation circuits. Since the regulation circuits of the individual zones operate independently of one another, there is only permissible in each individual zone a certain maximum value for the pressure differential at the top/bottom, in order to preclude any distortion of the roll shells.

Figure 4:
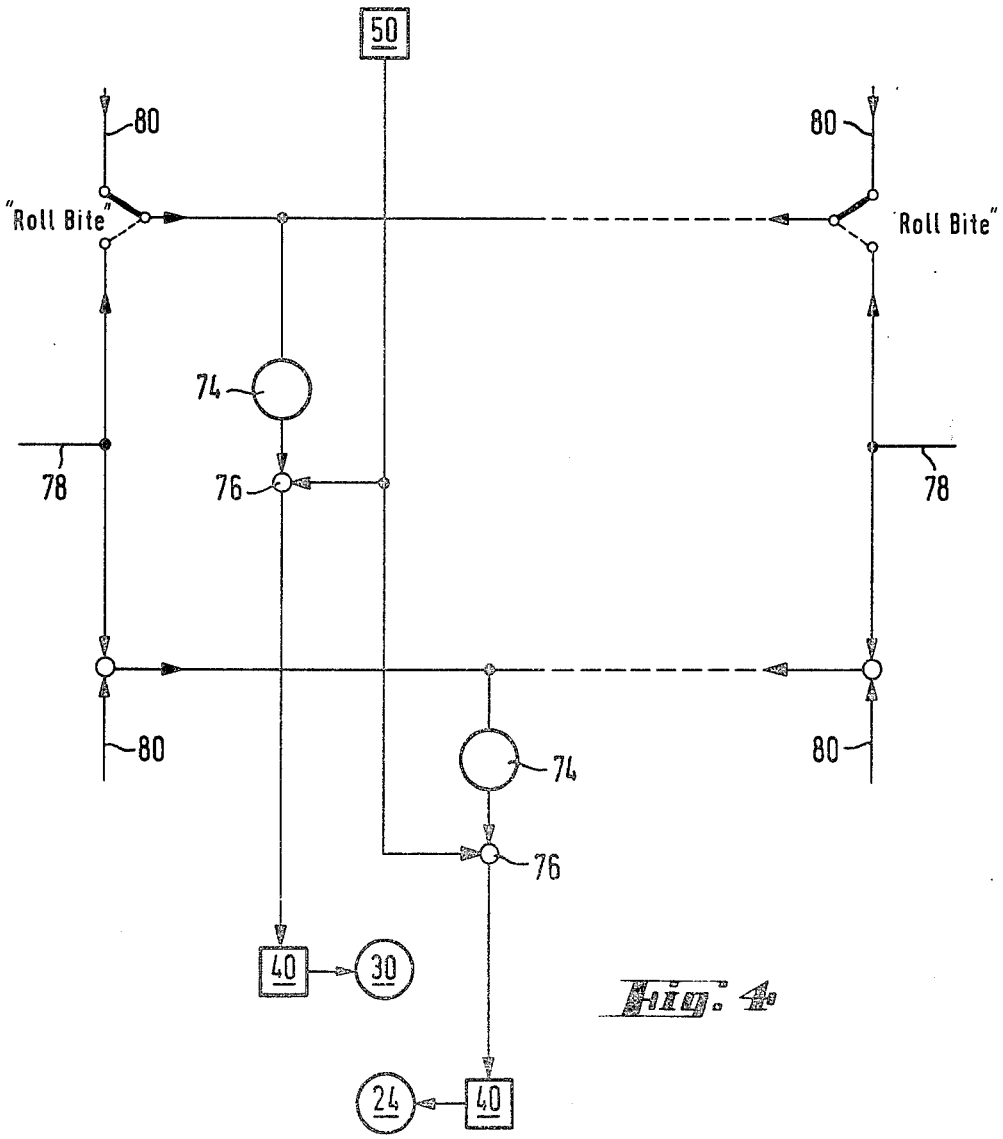
FIG. 4 illustrates a possible arrangement for processing the reference or set value for the pressure regulation circuit depicted in FIG. 3.

The set or reference value distribution, only indicated in FIG. 2, has been shown in detail in FIG. 4 for only one of the zones. For each pressure regulator 40 there is required its own set or reference value, which can be formed from the measuring values for the position of the roll shell in relation to the related roll support or beam or in relation to another stationary or static point. The actual value of the position of the roll shell is detected at its two ends. If both actual values are the same then the roll shell is horizontally disposed, and corresponding pressure corrections during deviation from the set or reference value act uniformly at the regulators 40. However, if both of the actual values differ from one another, then that means that the roll shell is in an inclined or oblique position, and there is accordingly undertaken a pressure correction only at the one roll half in the one direction, at the other roll half a pressure correction in the other direction.

When working with five zones as assumed for the exemplary embodiment, the regulator 40 for the intermediate or middle zone only receives the so-called "synchronism part" while the remaining regulators receive a weighted part of the possible actual-value difference plus the synchronism part. This weighting is symbolized by the function transmitter 74. Behind the function transmitter 74 there is inputted at an adder element 76 a possibly present correction signal.

Under certain operating conditions, such as startup or test run, there are regulated both the position of the lower roll shell 26 as well as also the upper roll shell 28 starting from their own reference or set values. On the other hand, during the rolling force or roll nip-controlled mode of operation there are only employed the actual-value signals of the lower roll shell 26 for the position regulation of both roll shells 26 and 28, however modified by the adjustment signals of the nip or force regulation circuit, which appear at the line 78. For the closed regulation circuit it is functionally equivalent whether the adjustment signal of the overriding regulation circuit is inputted as a reference or set value for the subordinate regulation circuit or as an adjustment magnitude, as is here the case.

Figure 5:
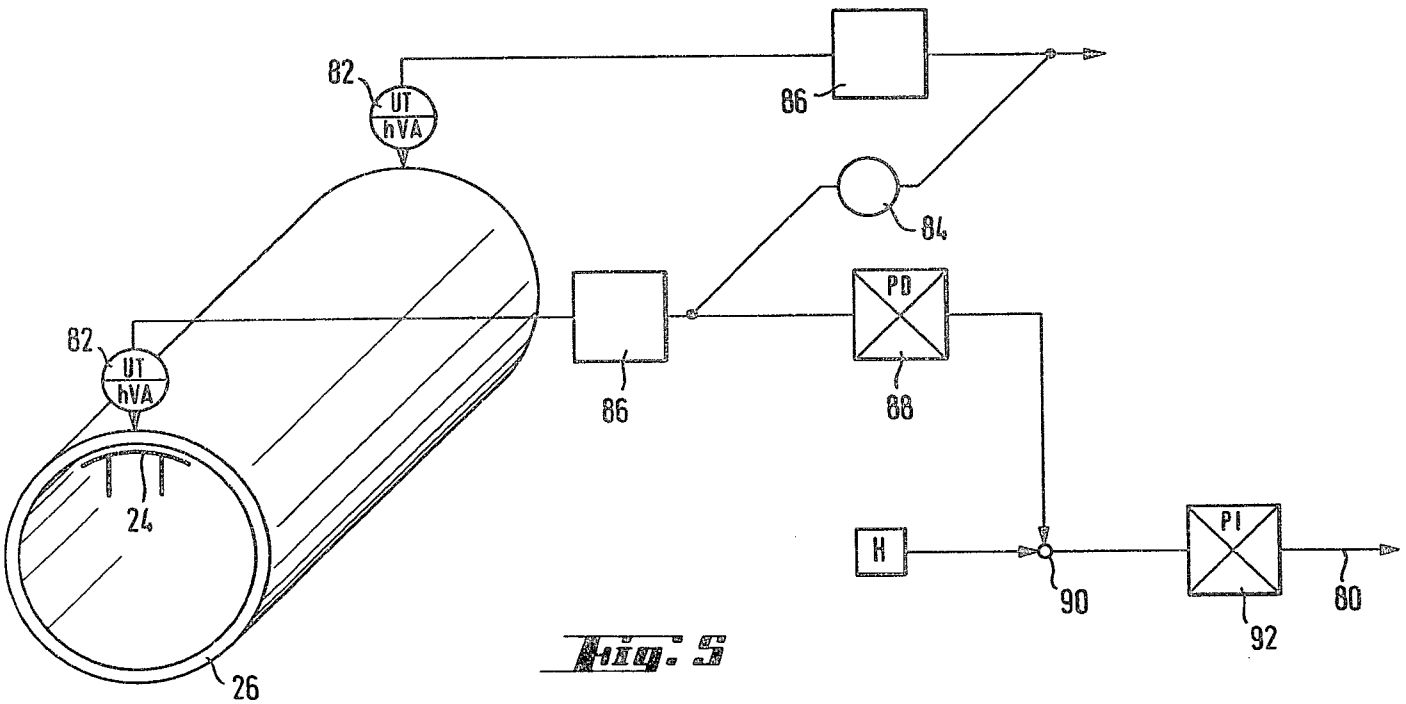
FIG. 5 is a block circuit diagram showing details of the construction of a position regulation circuit.

The preparation of the position adjustment signal, inputted by means of the line 80, has been illustrated in FIG. 5. The position transmitters 82 provided at both roll ends trigger an alarm upon exceeding predetermined threshold or boundary values, if, namely, the stroke of the hydrostatic pressure or support elements is about to be exceeded, or there exists the danger that the roll shell will contact against its roll support or beam. The actual-value signal comparator 84, for similar reasons, triggers an alarm in the event of impermissible inclined or oblique positioning of the roll shell. By means of accommodation elements 86 and PD-elements 88 the actual values are inputted to the comparators 90, at the other inputs of which there appear the reference or set values. The resultant adjustment signal is formed by a PI-regulator 92. This is true for the lower roll shell 26; for the upper roll shell 28 there are only provided a P-element and a P-regulator, so that the regulators do not operate in opposition to one another with closed, empty roll nip 100'.

Figure 6:
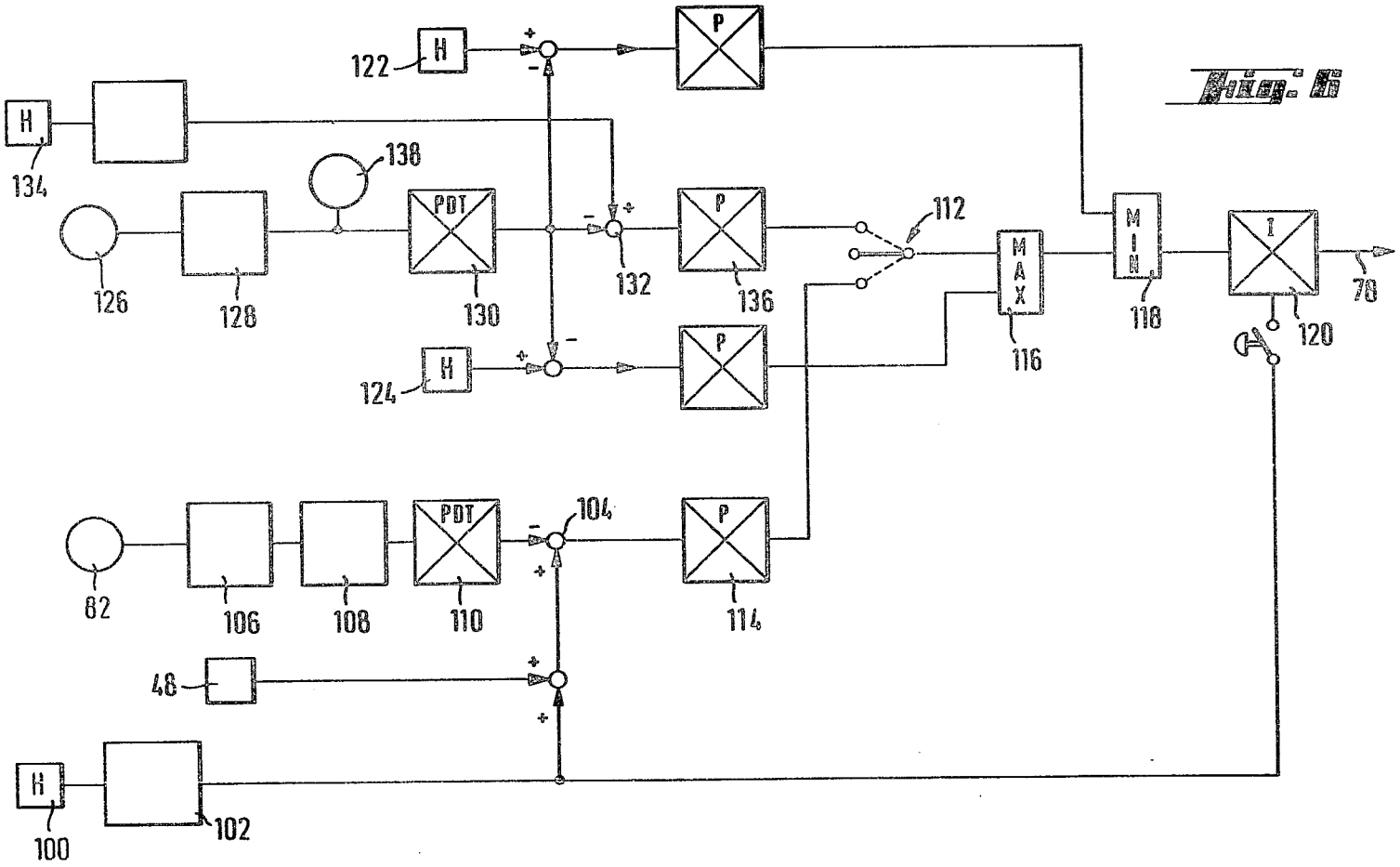
FIG. 6 illustrates in block circuit diagram the roll nip-/roll force regulation circuit.

In FIG. 6 there have been illustrated collectively the elements for the roll force or roll nip regulation.

At location 100 there is inputted the nip set or reference value, which is then processed at the reference or set value converter 102, compared at the comparator 104 with the actual value obtained from the position measurement and processed by means of the converter 106 and computed at the function generator 108 into a nip-actual value. This actual value is then applied by means of PDT-element or network (differential amplifier having a timing element) 110 to the comparator 104. By means of a switch 112 for the nip regulation/force regulation, arranged after the regulating amplifier 114, the adjustment signal passes through a first maximum-boundary or threshold element 116 and a second minimum-boundary or threshold element 118 as well as an integrator 120, before it is inputted as a reference or set value to the reference value distributor, as described above.

The function of the aforementioned components is known as such in the electronics art. However, what is worthy of mention are both of the limiters or threshold elements which are intended to preclude the inputting of unrealistic nip magnitudes: if, for instance, the machine operator inputs at element 100 a nip width which is greater than the infeed thickness of the metal which is to be rolled, then the minimum limiter or threshold element 118 is activated; conversely, if there is inputted too small of a nip width, so that the resultant forces would damage the installation, then there is activated the maximum limiter or threshold element 116. The boundary or threshold values of both of these limiter elements 116 and 118 can be predetermined by means of the elements 124 and 122, respectively; both of the limiters 116 and 118 are thus in operation both during the nip regulation and also during the force regulation.

For force measurement purposes there are used force measuring cells 126 at both ends of the rolls, for instance provided at the mounting elements of the work rolls. By means of the accommodation element 128 and the PDT-element 130 the actual-value signal arrives at the comparator 132, where it is compared with the force reference or set value signal which can be preselected at the reference value-preselection element 134. By means of a P-regulator 136 and the reversing switch 112 the adjustment signal is inputted to the reference or set value distributor for the pressure regulators. A force monitor 138 sounds an alarm in the presence of impermissibly high actual values of the forces. It is believed to be evident that for the reliable operation of the limiters or threshold elements 116 and 118 the roll force measurement must be continuously in operation, even if there is regulated a nip width. The interconnection with the adjustment elements 122 and 124 will be apparent from the illustration of the circuitry depicted in FIG. 6.

During operation, when one of the limiters 116 or 118 responds, there is automatically switched-over to a roll force regulation, and there is strived for a bumpless transition of the reference or set values for the pressure regulators. It should be understood that the resultant reference or set values always must lie in the work region of the pressure regulation, otherwise there must be triggered at least an alarm.

Figure 7:
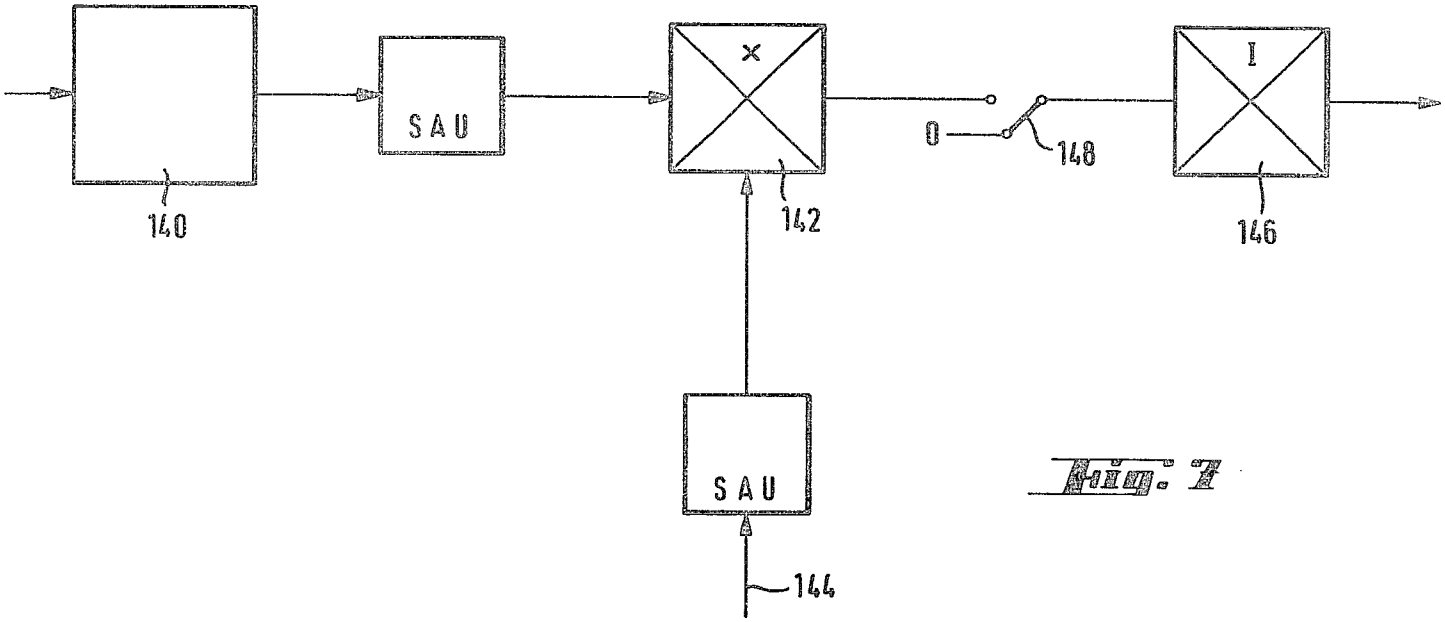
FIG. 7 illustrates a block circuit diagram of a possibility of utilizing the output signals of a bandthickness measuring device for undertaking corrections.

Finally, FIG. 7 illustrates the formation of a correction signal from the measured thickness of the rolled material or band. A standard thickness measuring device 140 delivers a first actual value which is then combined in the multiplier 142 with the actual value of the band velocity, appearing at the line or conductor 144, and inputted to the integrator 146. The cut-off switch 148 enables inputting the thickness correction only during the roll gap regulation; additionally, it is brought into the OFF-position when the limiters or threshold elements 116 and 118 respond.

While there are shown and described present preferred embodiments of the invention, it is to be distinctly understood that the invention is not limited thereto, but may be otherwise variously embodied and practiced within the scope of the following claims. ACCORDINGLY, What I claim is:

1. An arrangement for regulating a four-high rolling mill for rolling metal, said rolling mill having work rolls which are controlled by guided roll shells of a lower controlled deflection roll and an upper controlled deflection roll, the roll shells of which bear against a related roll support by means of hydrostatic pressure elements exerting a pressure therebetween, said regulation arrangement comprising:

first regulation circuits for regulating said pressure exerted by said hydrostatic pressure elements;

at least one second regulation circuit for regulating the position of said roll shells;

said at least one second regulation circuit being provided with means for overriding said first regulation circuits and for impressing adjustment output magnitudes of the second regulation circuit upon the first regulation circuits as adjustment magnitudes;

at least one third regulation circuit for selectively regulating either the roll force or the roll nip; and said at least one third regulation circuit being provided with means for overriding the first and the at least one second regulation circuits and for impressing adjustment output magnitudes of the at least one third regulation circuit upon the first regulation circuit as adjustment magnitudes.

2. The regulation arrangement as defined in claim 1, further including:

a fourth regulation circuit for regulating the thickness of the rolled material, and said fourth regulation circuit being provided with means for overriding said third regulation circuit and for impressing adjustment output magnitudes of the fourth regulation circuit upon the third regulation circuit as adjustment magnitudes.

3. The regulation arrangement as defined in claim 1 or 2, wherein:

said hydrostatic pressure elements are arranged in groups;

a common adjustment element controlling said groups of hydrostatic pressure elements; and a separate pressure regulator being operatively associated with each of said groups of hydrostatic pressure elements.

4. The regulation arrangement as defined in claim 1, further including:

hydraulic balancing cylinder means between said work rolls for spreading apart said work rolls; and said hydraulic balancing cylinder means operating during the rolling operation.

5. The arrangement as defined in claim 1, further including:

controllable valve means constituting adjustment elements for the pressure regulation.

6. The regulation arrangement as defined in claim 1, further including:

controllable pumps serving as adjustment elements for the pressure regulation.

7. The regulation arrangement as defined in claim 1, further including:

an excess pressure monitor arranged after the individual adjustment elements.

8. The regulation arrangement as defined in claim 7, further including:

a safety valve operatively associated with said excess pressure monitor.

9. The regulation arrangement as defined in claim 1, wherein:

said first regulation circuits contain individual adjustment elements; and a throughflow rate monitor downstream from the individual adjustment elements for maintaining a minimum throughflow rate needed for lubrication of said hydrostatic pressure elements.

10. The regulation arrangement as defined in claim 1, further including:

a set value differential monitor;

the set values of the pressure regulation for oppositely situated hydrostatic pressure elements of the lower roll shell and the upper roll shell of the lower and upper controlled deflection rolls, respectively, appearing at inputs of said set value differential monitor; and said set value differential monitor having an output side for transmitting an alarm signal when a maximum permissible difference is exceeded.

11. The regulation arrangement as defined in claim 1, further including:

path monitors operatively associated with position transmitters at the roll shell-ends; and said path monitors maintaining the elevational position of the roll shell within an adjustment region of the pressure elements.

12. The regulation arrangement as defined in claim 1, wherein:

the position regulation circuit for the lower roll shell contains a PI-regulator.

13. The regulation arrangement as defined in claim 12, wherein:

the position regulation circuit for the lower roll shell contains a PD-element.

14. The regulation arrangement as defined in claim 17, wherein:

the position of the upper roll shell and the lower roll shell is regulated in each case by means of its own set values during roll nip regulation; and the regulation circuit contains a P-regulator for the upper roll shell.

15. The regulation arrangement as defined in claim 13, wherein the position of the upper roll shell and the lower roll shell is regulated in each case by means of its own set values during roll nip regulation; and the regulation circuit for the upper roll shell contains a P-regulator.

16. The regulation arrangement as defined in claim 1, further including:

pressure measuring cells constituting actual value transmitters provided for the roll force regulation.

17. The regulation arrangement as defined in claim 16, wherein:

the roll force regulation circuit comprises an I-regulator.

18. The regulation arrangement as defined in claim 17, further including:

a PD-element for inputting actual values of the roll force to the regulator.

* * * * *

UNITED STATES PATENT AND TRADEMARK OFFICE

CERTIFICATE OF CORRECTION

PATENT NO. : 4,481,799

DATED : November 13, 1984

INVENTOR(S) : ADOLF GLATTFELDER et al

It is certified that error appears in the above-identified patent and that said Letters Patent is hereby corrected as shown below:

In the Abstract, line 14, after "adjustment" please insert --input--

Column 10, line 15, (Claim 14, line 2), delete "17" and insert --12--

Signed and Sealed this

*Second* Day of *July 1985*

[SEAL]

*Attest:*

DONALD J. QUIGG

*Attesting Officer*

*Acting Commissioner of Patents and Trademarks*